United States Patent [19]

Sawvel

[11] Patent Number: 4,473,098

[45] Date of Patent: Sep. 25, 1984

[54] CONTAINER TRANSPORT DEVICE FOR USE WITH FILLING EQUIPMENT

[76] Inventor: Thomas D. Sawvel, 10540 Ewing Ave. S., Bloomington, Minn. 55431

[21] Appl. No.: 505,320

[22] Filed: Jun. 17, 1983

[51] Int. Cl.[3] ..... B67C 3/04

[52] U.S. Cl. ..... 141/172; 141/131

[58] Field of Search ..... 53/267, 471; 141/1, 141/131, 132, 153, 165, 172, 253, 257, 275

[56] References Cited

U.S. PATENT DOCUMENTS 2,651,445 9/1953 Kennedy, Jr. ..... 141/131 X
4,399,845 8/1983 Stanton ..... 141/172 X

FOREIGN PATENT DOCUMENTS 0620064 4/1927 France ..... 141/165

*Primary Examiner*—Charles E. Phillips
*Assistant Examiner*—Mark Thronson
*Attorney, Agent, or Firm*—James R. Cwayna

[57] ABSTRACT

A container transport device for the filling of containers with semi-liquid material such as ice cream or the like with the primary aspects of this invention being related to the transportation of the containers from a supply conveyor to a filling station and thereafter to an area which may provide lid application and then to a delivery conveyor. The primary aspects of this invention are the positive control and movement of the containers through the various stations and the proper centering thereof with respect to the filling device. To obtain proper control of the containers through the various operations, a set of longitudinally shiftable and transversely shiftable fork elements are provided for shifting of the containers and the shifting of the containers is correllated with a container elevating device which device elevates the container to a stationary filling head such that filling is started at the very bottom of the container and upon completion the filled container is positioned above the next incoming container such that material being delivered to the containers is not stopped between containers, but rather, the differences in elevation will allow movement of the incoming container into position below the filling spout without overdripping of the material between containers. The device also provides structure for the control of the volume that will be delivered to the container.

20 Claims, 13 Drawing Figures

CONTAINER TRANSPORT DEVICE FOR USE WITH FILLING EQUIPMENT

FIELD OF THE INVENTION

This invention relates generally to container filling devices, and more particularly to a positive container transport means for shifting containers from an entrance station through a filling, a possible lid application and a delivery station, and having means from positively centering the container above an elevating unit arranged at the filling station with the filled container being in elevated condition with respect to empty containers being supplied.

BRIEF DESCRIPTION OF THE INVENTION

A container transport mechanism for use with filling and lid applying devices which includes a container supply conveyor, a filling station, a possible lid application station, and a filled container delivery conveyor. A set of forks is provided for both longitudinal and transverse movement to receive containers from the supply conveyor, to transport them into the filling station and subsequently after filling, through the lid application station and finally, onto the delivery conveyor. The unit further includes a pair of spring-loaded centering arms which will positively center the container being delivered above an elevating device at the filling station. The concept of filling is to elevate the empty container upwardly about a stationary material-delivery head and as material is delivered into the container, the weight of the material will lower the container and the elevating mechanism to a level above the supply conveyor such that when the now filled container is moved from the filling station, it is not necessary to stop the flow of material from the filling head as the speed at which the next container is brought in to the filling station will not allow any of the material to drip between the containers, but rather there will be a cascading effect from the filled container to the empty container.

The transport device also provides adjustment for the amount of filled desired. This is controlled by the downward stroke of the elevating mechanism and a switch mechanism will control an operable power cylinder to ensure rapid downward movement when the desired level of the material is delivered to the container.

The mechanism for centering the container provides structure to ensure that the container will not be tipped as it is being driven from the supply conveyor into the filling station area. This centering mechanism also provides a means for retaining the filled container at an elevated position above incoming, empty containers for ultimate delivery to the lid application area and to the delivery conveyor.

With the applicant's concept, many of the filling devices which are presently available may be changed into automatic operation from manual operation or the device may include a filling unit and a lid application unit, but the primary concern and primary invention with which this application is concerned is the transportation and positive location of the containers with respect to a filling operation and a lid application operation.

BACKGROUND AND OBJECTS OF THE INVENTION

The applicant is well skilled in the knowledge of machines for filling containers with materials which are in a semi-liquid condition. These materials include ice cream, cottage cheese, and other materials which are in a flowable condition. With his knowledge of the art, it is the applicant's considered opinion that the art does not include the combination of positive movement of containers through the necessary operations in combination with positive location and control of the container so as to positively center the same and to prevent the container from being tipped during its transportation. Further, the art does not provide a unit which allows for a wide degree of control of the amount of fill and does not provide a higher elevation of the filled container with respect to the oncoming empty container so as to prevent any spillage of the material during container shifting and allowing continual flow from the filling head.

In accordance with the backgrounds of the invention, it is therefore an object of the applicant's invention to provide a container transport unit for use in conjunction with a material delivery head for the filling of containers with semi-liquid material, which ensures positive transportation of the containers in both their empty and full states.

It is a further object of the applicant's invention to provide a container transport unit for use with filling equipment for the filling of the containers with semi-liquid material which includes mechanisms for automatic centering of the container with respect to the material delivery head with the centering device also providing an elevating or elevation-shifting arrangement for the filled container.

It is a further object of the applicant's invention to provide a container transport mechanism which ensures that the containers to be filled will be delivered to the various steps of filling and lid application in an upright condition and will prevent tipping of any of the container and therefore, malfunction of the unit.

These and other advantages of the applicant's application will more fully appear upon consideration of the accompanying description which incorporates the included drawings.

DESCRIPTION OF A PREFERRED FORM OF THE INVENTION

Figure 1:
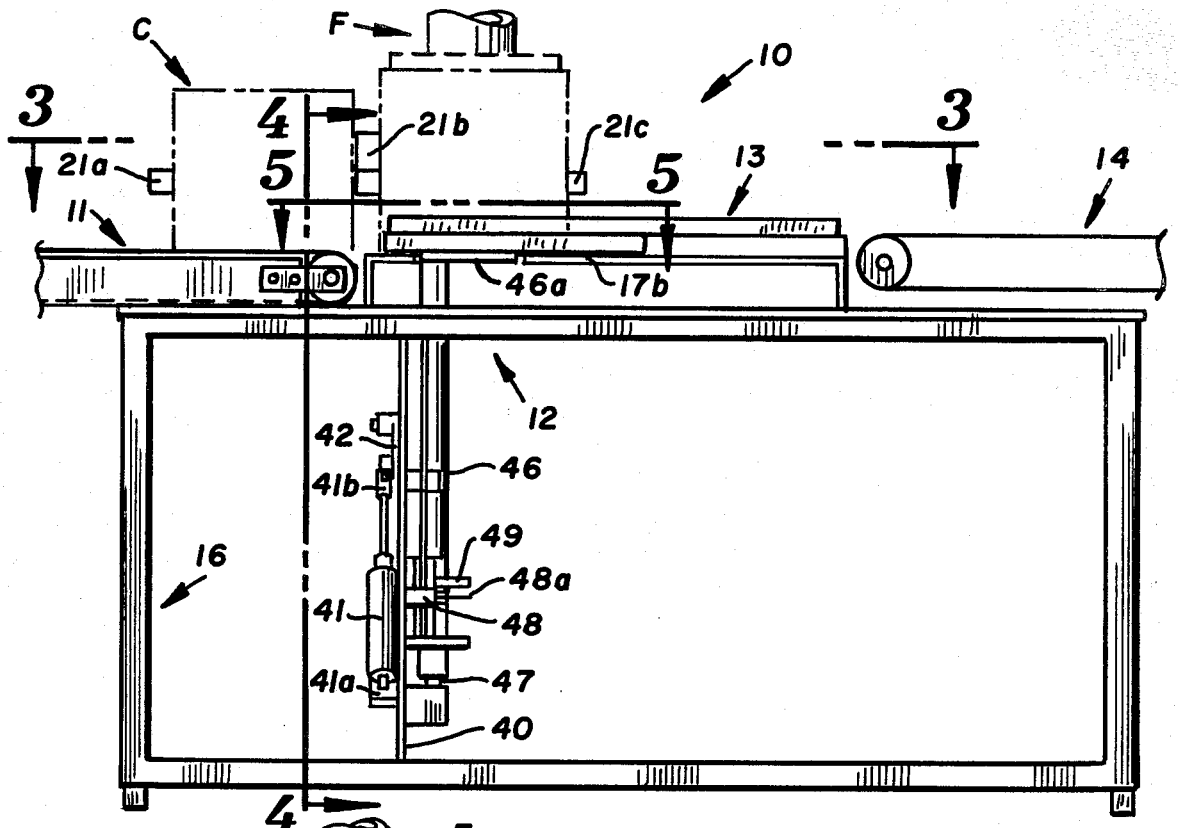
FIG. 1 is a side view of the container transport device embodying the concept of the applicant's invention, and illustrating, in dotted lines, a filling head and containers which are being transported through the various operative steps of the device.
Figure 2A:
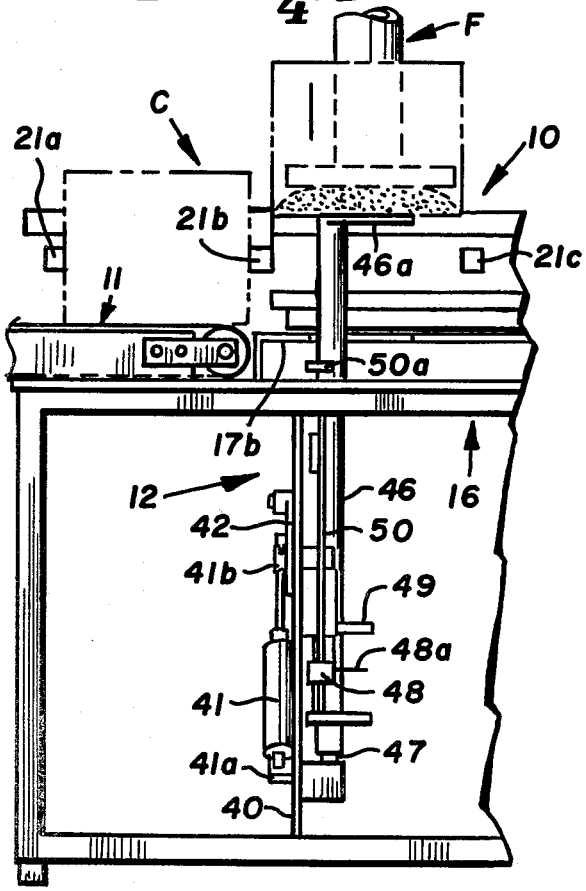
FIG. 2*a* illustrates a portion of FIG. 1 showing a container which has been elevated for filling and which is descending as the material is being delivered into the container from the filling head.
Figure 2B:
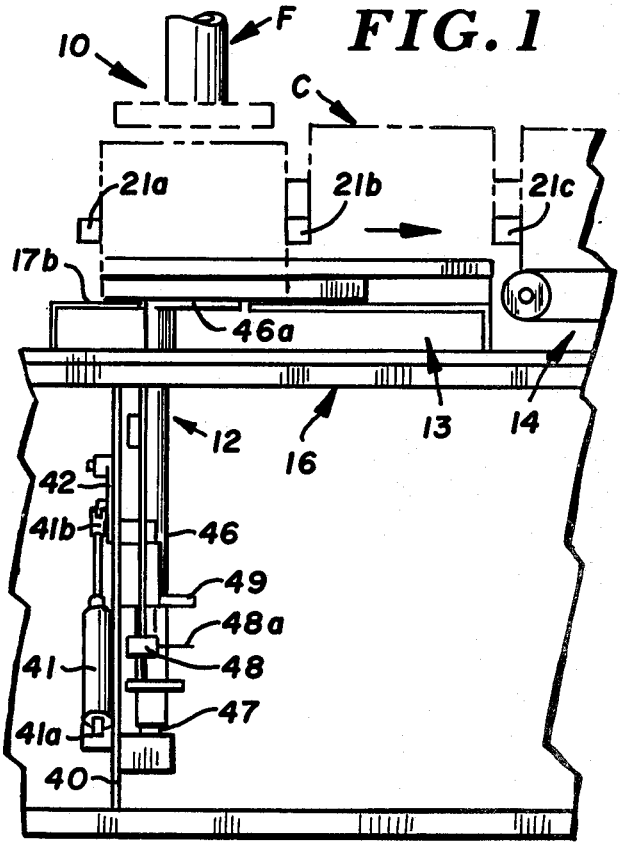
FIG. 2*b* is similar to FIG. 2*a* and illustrates the transportation of the filled container with the next entry container being positioned below the filling head and in position to be raised for filling and illustrating the condition wherein a filled container is at an elevation higher than the empty container.

In accordance with the accompanying drawings, the container transport device embodying the concepts of the applicant's invention is generally designated 10. The unit includes an empty container conveyor section 11, a filling station generally designated 12, a second receiving section which may incorporate a lid applicator generally designated 13, a full container discharge conveyor 14, and a container-moving fork section generally designated 15. All of these sections are mounted on a frame unit generally designated 16, the frame unit 16 obviously supplying support and support brackets for the various members that are mounted thereon.

Illustrated above the filling station 12 and illustrated in dotted lines is a filler unit generally designated F. The unit shown is one of many types of filling devices with which this transfer unit may be utilized or the transfer unit may include its own filling structure, but such filling structures do not necessarily provide any portion of this invention. Also illustrated in dotted lines on the unit to illustrate the operation and movement of the unit are containers designated C. It should also be understood that the unit preferrably includes a lid application section at the second receiving section. The drawings do not illustrate any particular type of lid application arrangement as again, this unit is adaptable for various types of lid application units, or if desired, the lid could be placed on the filled carton at a remote location.

Figure 3:
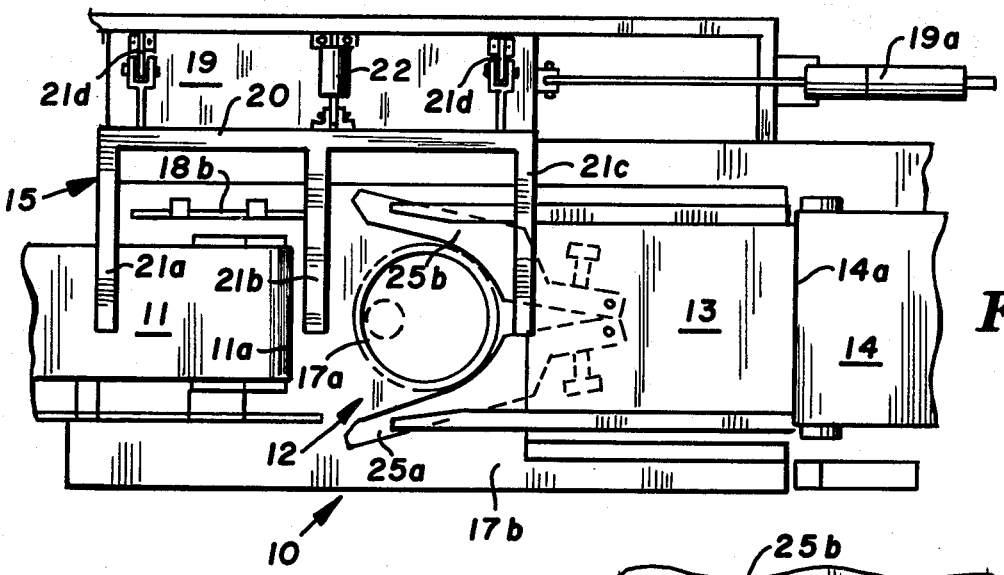
FIG. 3 is a horizontal section taken substantially along Line 3—3 of FIG. 1 and illustrating in dotted lines, the position of an empty container with respect to the centering means.

As illustrated in the top view of FIG. 3, a first support surface 17 is provided on the frame and the delivery end 11*a* of the supply conveyor 11 is supported thereby. Conveyor 11 terminates short of the positioning and filling section 12. Support means similarly must be provided for the delivery conveyor 14, as at 14*a*. Such conveyors 11, 14 are well-known in the art, and no further description of such a device is deemed necessary.

Figure 4:
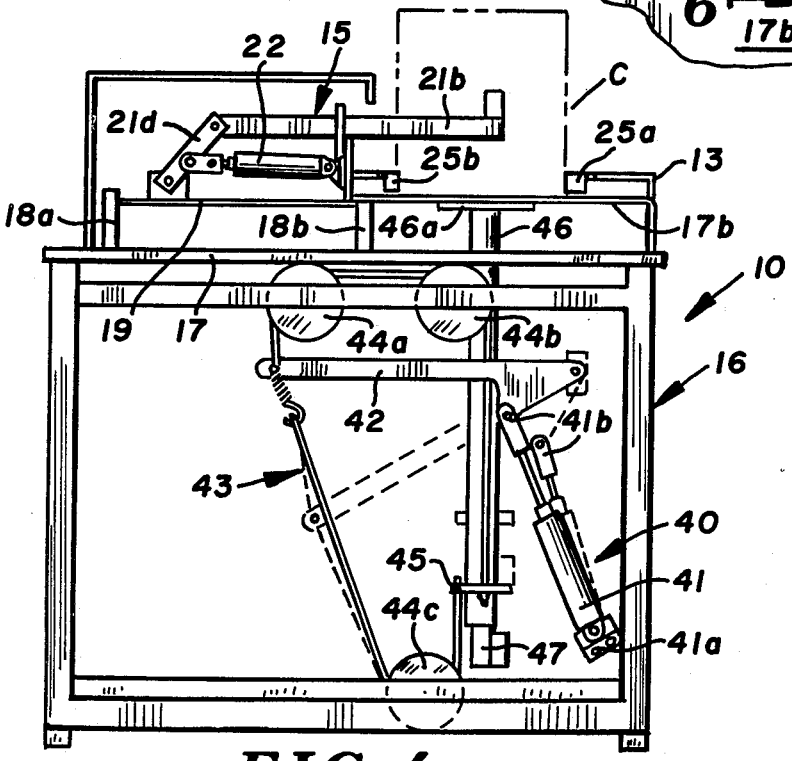
FIG. 4 is a vertical section taken substantially along Line 4—4 of FIG. 1.

The entire fork structure 15 is mounted for longitudinal movement on the first support surface 17 of the frame 16, and to obtain this type of situation, vertically provided supports 18*a*, 18*b* are provided to extend longitudinally of the unit with a slidable plate 19 provided therebetween, upon which the fork structure 15 is mounted. As best illustrated in FIGS. 3,4, the guiding fork structure 15 includes a longitudinally extending support bar 20, having three transversely extending fingers 21*a*, 21*b*, 21*c*, the length of such fingers predetermined such that they may be shifted transversely into and out of contact with the containers that are being carried on the various sections or stations of the unit. In order to accomplish such shifting of the fork structure, a linkage member 21*d*, is provided to allow transverse shifting of the fingers or arms 21*a*, 21*b*, 21*c*, in a horizontal plane through actuation of a cylinder member 22. Longitudinal shifting of the unit is obtained through a cylinder 19*a* which drives the entire carrying plate 19 in a longitudinal motion. It should be obvious that the length of the extending arms 21*a*, 21*b*, 21*c*, and linkage 20 should preferably allow the arms to reach at least the vertical central axis of the containers for proper movement thereof. It should also be obvious that the stroke of longitudinal movement of plate 19 may be varied dependent upon the particular size of the container being shifted.

Figure 5:
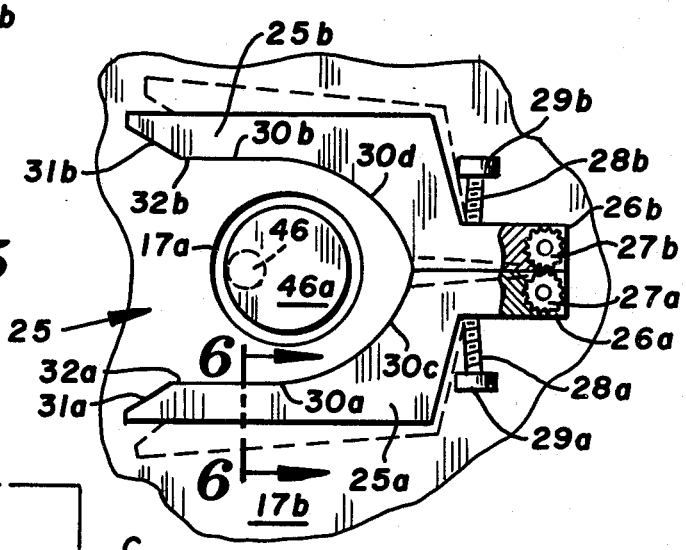
FIG. 5 is a horizontal section taken substantially along Line 5—5 of FIG. 1 and particularly illustrating the manner in which the centering forks operate.
Figure 6:
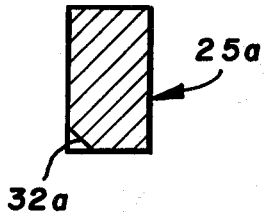
FIG. 6 is a section taken substantially along Line 6—6 of FIG. 5.
Figure 7A:
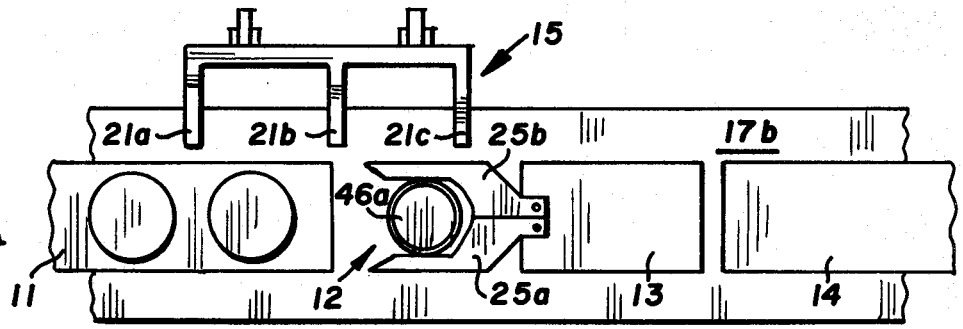
FIGS. 7*a* through 7*f* are schematic illustrations showing transfer of containers from the empty supply container conveyor into the filling station, into the possible lid application station, and ultimately on to the filled container delivery conveyor.
Figure 7B:
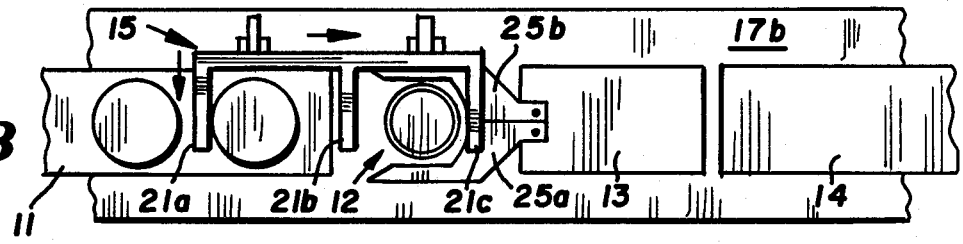
Figure 7C:
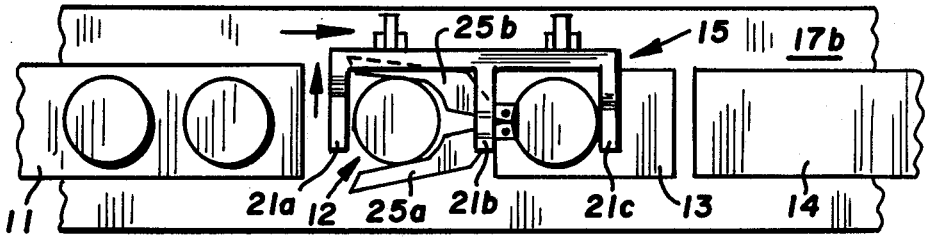
Figure 7D:
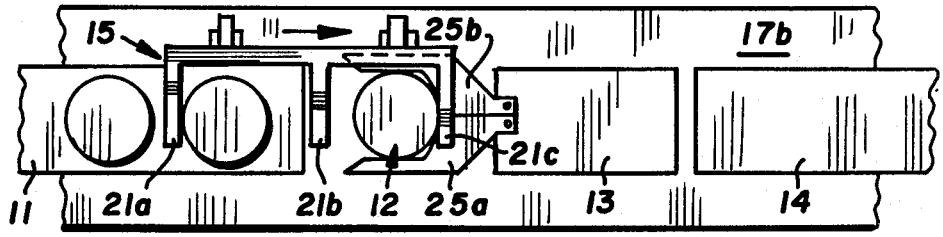
Figure 7E:
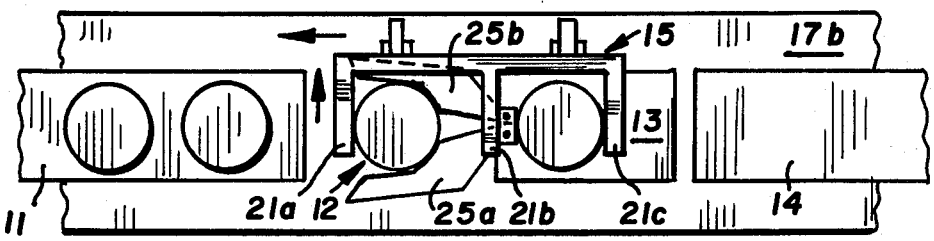
Figure 7F:
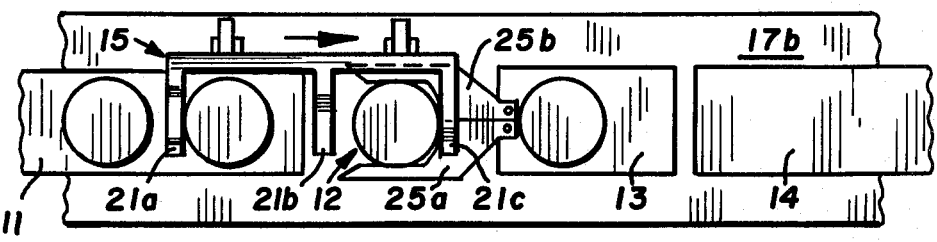

The centering fork structure 25 to center the containers over the elevating portion of the filling station 12 is best illustrated in FIGS. 3, 5, 6. The particular forks which provide for centering of the containers are designated 25*a*, 25*b*, and the forks are pivotally mounted to a plate 17*b* elevated above plate 17 to form a first receiving station which is in horizontal alignment with the upper run of conveyor 11 through pin members 26*a*, 26*b*. Each of the forks 25*a*, 25*b* are provided with spur gears 27*a*, 27*b* which will ensure that the forks 25*a*, 25*b* will open and close to the same degree. As illustrated in FIG. 5, spring means 28*a*, 28*b*, are provided between the forks 25*a*, 25*b*, and mounts 29*a*, 29*b*, are secured to the first plate 17*b*. The concepts of these forks is to, when no container c is positioned therebetween, be in parallel or what may be termed a closed position and to spread to an open position when a container is forced therein.

The internal surfaces of forks 25*a*, 25*b* are provided with straight sections 30*a*, 30*b* and arcuate sections 30*c*, 30*d*.

The arcuate sections 30*c*, 30*d* are designed to conform to the periphery of the container c when the forks 25*a*, 25*b* are spread.

The cross-section of FIG. 6 is typical of both of the forks 25*a*, 25*b*. As illustrated in FIG. 5, the forks 25*a*, 25*b* are provided with an introductory angle 31*a*, 31*b*, on the ends thereof, and are also provided with an angular undercut, relief angle 32*a*, 32*b* provided on the inner lowermost edge of the fork arms 25*a*, 25*b*. The concept of this undercut is that an ice cream container is provided with a lower metal rim which extends outwardly from the normal periphery of the container. By providing this undercut, the lower rim is captured by the fork and the moving arms 21*a*, 21*b*, 21*c* will not tip the container, as they move the same. Obviously, the arms 21*a*, 21*b*, 21*c*, may be above the center of the container, and if this relief, capturing undercut were not provided, longitudinal motion of the arms could cause the container to tip over. This undercut extends along the straight interior side 30*a*, 30*b* of the forks 25*a*, 25*b*, and terminates at the start of the arcuate portions 30*c*, 30*d*. In this manner, as the forks are spread apart into the dotted line position of FIG. 5, the lower edge of the container is no longer captured, and therefore it is possible to elevate the container vertically. Upon elevation of the container, the spring members 28*a*, 28*b*, will cause the forks to resume the solid line or closed position of FIG. 5 and therefore, upon descent of the now filled container, it will come to rest on the upper surfaces of the forks 25*a*, 25*b*, and will thus be in alignment with the second surface or lid applying section 13 and the upper surface of the delivery conveyor 14. This second surface 13 is obviously above the first plate 17*b*.

The means for elevating the empty container for filling is illustrated in FIGS. 1, 2*a*, 2*b*, and 4. As illustrated therein, a vertical mounting plate 40, for the pivotal mounting of a power air cylinder 41 thereon with one end 41*a* being pivotally mounted on the support frame 40, and the other end 41*b* being attached to a pivotally mounted control arm 42. Control arm 42 extends transversely across the framework of the device and is attached to a control line structure designated in its entirety 43. As illustrated in FIG. 4, three individual roller members 44*a*, 44*b*, 44*c*, are provided for guiding the control line 43, and the ends of the line are attached to a flange 45 which is secured to a control piston 46, which control piston is slidably mounted on a shaft 47. Obviously, shaft 47 must provide vertical guidance for the piston 46.

As illustrated in FIGS. 3 and 5, an aperture 17*a* is provided in the first receiving plate 17*b* to permit vertical movement of the cylinder 46, and the cylinder 46 is provided with a platform 46*a* at the upper surface thereof, which will obviously meet with the bottom of the container and lift and position the same about the filling head F. When the container is moved into its uppermost position, filling, for example, if this is the first such container, will begin, and the weight of the material will force the container downwardly. It should be noted that, at this time, the container having been removed from the forks 25*a*, 25*b*, the forks will now close, and upon descent of the container, the container will come to rest upon the upper surface of the forks 25*a*, 25*b* and thus be at a level above the oncoming empty containers, and at the level of the lid-applying or second receiving surface 13, and the delivery conveyor 14.

As further illustrated in these views, a control switch mechanism is provided on the support plate 40 and the cylinder 46. The switching mechanism includes a switch 48 having an extending actuating arm 48*a* or plate 40 and an actuating member 49, arranged on the cylinder 46. The switch mechanism 48, 48*a*, is arranged on an adjustable screw-type rod 50, with a control knob 50*a* in accessible postion to the operator such that the switch 48 and the sensing arm 48*a*, may be moved upwardly or downwardly. The concept of this arrangement is to allow control of the filling of the container C, to any particular height. As the actuating arm 49 on the cylinder 46 moves downwardly due to the falling of the container, it will trip the switch 48 through abutment with the switch arm 48*a* and when this occurs, the power cylinder 41 is automatically extended to rapidly drop the cylinder 46, lifting plate 46*a*. This will allow the container to drop onto the top of the forks 25*a*, 25*b*. It should be obvious from this particular structure that the level of filling then can be controlled in any manner simply by the location of the switch mechanism 48, along the adjustable rod member 50.

Normally, with an ice cream container, the lower metal binding rim extends longitudinally past the bottom of the container, and it is necessary that this lifting member be positively withdrawn before the container is moved to the next station, and this is done rapidly through the power cylinder 41. The tripping of the switch 48 also correlates the movement of the aforementioned transversely extending fork structure 21*a*, 21*b*, 21*c*. When this switch is tripped, the entire fork structure is shifted longitudinally to thereby shift the now filled container on to the second surface or lid-applying section 13.

It is obvious that the operation of the lifting cylinder, its downward travel, and the resultant fork structure movement is timed for rapid advancement of the containers, and further consideration of such movement is illustrated in FIGS. *7a* throught *7f*.

In FIGS. *7a* through *7f*, the assumption is made that an empty container is being delivered by the conveyor 11, and at this point, no operation of the machine has begun. In this condition, the fork structure 15 is remote from contact with the containers and the fork structure 25*a*, 25*b* is in the closed position.

FIG. *7b* illustrates the first inward movement of the transfer fork structure 15 to capture the container being delivered on conveyor 11. After the transverse inward movement, the fork structure 15 is then driven, in the particular form shown, being a right-hand delivery system, to the right. This results in the situation as illustrated in FIG. *7c*, placing the container into the forks 25*a*, 25*b*. At this time, cylinder 46 lifts the container into material-delivering position, about the feeding member F, as best illustrated in FIG. *2a*. At this point, fork members 25*a*, 25*b* will return to closed position. Simultaneously, with this movement, the fork structure 15 will be retracted and shifted to the left to resume the position of FIG. 1. Upon filling of the container, and lowering of cylinder 46 to trip the switch 48 through contact of the control arm 49 with the switch-sensing arm 48*a*, the arm structure 15 will again move transversely and capture the now filled container between arms 21*b*, 21*c* and likewise capture the oncoming container on conveyor 11 between arms 21*a* and 21*b*. At this point, the arm structure 15 again is shifted to the right to assume the position of FIG. *7e*, wherein the filled container is now on the second surface or lid-applying section 13, and the empty container is moved into the filling area between the forks 25*a*, 25*b*. Again, at this time, the fork structure 15 is retracted and shifted to the left. Upon completion of filling of the second container, the arm structure 15 is moved forward, and an empty container is again captured between arms 21*a*, 21*b*, and the second filled container is captured between arms 21*b*, 21*c*. Again, the arm structure is shuttled to the right, and this will cause arm 21*c* to force the first filled container, which has been on lid applying station 13 or second surface, on to the delivery conveyor 14, and will deposit the second filled container onto section 13, and will place a now empty container into the positioning fork and filling area 12.

The operation then becomes sequential, which may be considered to be primarily controlled by the switching mechanism 48*a*, and actuating member 49, on the vertically movable cylinder 46. Whenever this switch mechanism is tripped, due to lowering of the cylinder by the filled container, the arm structure 15 is controlled to immediately shift the filled container from the filling area onto the second surface or lid-applying area, and provide an empty container into the filling area. The operation then is sequential, but is continuous, and will always positively drive the empty as well as filled units. An important aspect of the invention is the elevation of the filled containers above the height of the oncoming empty containers. This elevation difference allows for the movement of the containers, and the continuous flow of material from the feeding head, as the lower level of the empty container allows the material to pass over the gap caused by the fork 21*b*, without loss of material, and without dripping of same on to the operative sections of the unit.

It should be obvious that the applicant has provided a unique container transport device for use with material filling machinery, which ensures proper positioning of containers with regard to the filling equipment, which provides for upright maintenance of the containers through their movement, and which provides for elevation differentiation between filled and empty containers, such that continuous flow of the material may be maintained.

What I claim is:

1. A container transport device for use with container filling equipment for delivering containers to be filled to the filling equipment and for removing the containers after filling, said transport device including:

a. a longitudinally extending support frame;

b. a first, empty container, delivery conveyor arranged on one end of said frame, said delivery conveyor having an upper run, delivery surface;

c. a first receiving surface on said frame in substantially horizontal alignment with the upper run, delivery surface, of said delivery conveyor;

d. positioning means on said receiving surface in a normally closed condition to provide a receiving area of smaller dimension than the diameter of the container whereby said positioning means are spread to an open position upon receipt of a container, said positioning means having an upper surface, the upper surface of said positioning means being above said first receiving surface, said positioning means having receiving ends;

e. guide means on the receiving ends of said positioning means to receive a container therebetween and whereby said positioning means are spread to receive the container as the same is moved longitudinally on said receiving surface;

f. container elevating means arranged in at least horizontal relation to said first receiving surface and generally centrally of said positioning means to underlie a container received therein;

g. means for moving said elevating means in a vertical direction for filling the container and for moving the same from said positioning means to permit said positioning means to return to its normally closed condition;

h. a second receiving surface in horizontal alignment with said upper surface of said positioning means;

i. a second, filled container, delivery conveyor on another end of said frame and having an upper run in horizontal alignment with said second receiving surface; and, j. container moving means to shift empty containers from said first conveyor to said positioning means and, after filling, from said positioning means to said second receiving surface in a first step and to said second delivery conveyor in a second step.

2. The structure set forth in claim 1 and said positioning means including a pair of opposed arm members pivotally mounted on said first receiving surface, each arm providing an inwardly directed arcuate section and an inwardly directed striaght section, said straight sections being in parallel spaced relation when said means is in its normally closed position.

3. The structure set forth in claim 2 and the spacing between said straight arm sections being less than the diameter of the cotainer to be filled.

4. The structure set forth in claim 3 and said arm members having extending arms angularly formed to provide an entrance area for a container.

5. The structure set forth in claim 2 and said arcuate portions of said arms being designed and constructed to conform to the outer periphery of the container to be filled when said positioning means is in its open position.

6. The structure set forth in claim 2, for delivering and removing containers having lower peripheral rims, and the inner, lower-most portion of said straight sections of said arm members being angularly undercut to provide a capturing means for the lower peripheral rim of a container received therein.

7. The structure set forth in claim 2 and said arm members being provided with intermeshing gears adjacent the pivotal mountings thereof whereby said arms will be equally spread from the normally closed position.

8. The structure set forth in claim 2 and spring structure normally urging said arms to the normally closed position.

9. The stucture set forth in claim 1 and said container elevating means including a container contacting member arranged in at least horizontal relation to said first receiving surface and said means for moving said elevating means including a vertically moveable cylinder with means for driving said cylinder vertically upwardly.

10. The structure set forth in claim 9 and said means for driving said cylinder vertically including a two way power cylinder connected to said vertically moveable cylinder.

11. The structure set forth in claim 9 and said means for driving said cylinder vertically including:

a. a continuous connective line having its ends thereof respectively connected to said cylinder;

b. pulley structure operatively associated with said line;

c. an arm member pivotally mounted on said frame on one end thereof and connected to said connective line on the other end thereof; and, d. a power cylinder connected to said arm intermediate the ends thereof, said power cylinder being double acting whereby movement of the piston thereof in one direction will move said cylinder vertically upwardly and movement in the other direction will draw said cylinder vertically downward.

12. The structure set forth in claim 11 and sensing, switching means arranged and constructed to sense the downwardly directed movement of said cylinder and actuating said power cylinder to draw said cylinder downwardly when said cylinder reaches a predetermined position.

13. The structure set forth in claim 12 and said switching means being positionable whereby said power cylinder may be actuated to draw said vertically moveable cylinder downwardly at variable positions.

14. The structure set forth in claim 1 and said container moving means including transversely and longitudinally shiftable arm means arranged and constructed to shift transversely of said device for contacting containers and thereafter being longitudinally shiftable to move the container longitudinally of said device.

15. The structure set forth in claim 14 and said shiftable arm means including at least a pair of transversly extending arm members for capturing a container therebetween.

16. The structure set forth in claim 14 and said shiftable arm means including at least three transversely extending arm members for capturing a pair of containers.

17. The structure set forth in claim 14 and said container moving means including a longitudinally shiftable base member, and said arm means being transversely shiftable thereon.

18. The structure set forth in claim 17 and means for longitudinally, sequentially driving said base member whereby containers are sequentially shifted from said first delivery conveyor to said positioning means to said second receiving surface and to said filled container delivery conveyor.

19. The structure set forth in claim 1 and control means to sequentially control said means for moving said elevating means and said container moving means to permit container movement when said elevating means is at its lowermost position.

20. The structure set forth in claim 1 and sensing means for actuation of said means for moving said elevating means upon positioning or a container in said positioning means.

* * * * *